United States Patent [19]

Buescher et al.

[11] 3,974,414

[45] Aug. 10, 1976

[54] CATHODE RAY TUBE CATHODE

[75] Inventors: William E. Buescher, Seneca Falls, N.Y.; Donald R. Kerstetter, Emporium, Pa.

[73] Assignee: GTE Sylvania Incorporated, Stamford, Conn.

[22] Filed: July 9, 1975

[21] Appl. No.: 594,326

[52] U.S. Cl. ..... 313/331; 313/30; 313/37; 313/46; 313/270; 313/337

[51] Int. Cl.[2] ..... H01J 5/50

[58] Field of Search ..... 313/270, 337, 346, 30, 313/37, 46, 331

[56] References Cited

UNITED STATES PATENTS 2,912,611 11/1959 Beck et al. ..... 313/337

3,450,927 6/1969 Schmidt et al. ..... 313/337 X

*Primary Examiner*—Saxfield Chatmon, Jr.
*Attorney, Agent, or Firm*—Norman J. O'Malley; William H. McNeill; Robert T. Orner

[57] ABSTRACT

A fast warm up, die-drawn, low mass cathode cap is substantially cup-shaped having a closed end and an upstanding side wall integral therewith. The thickness of the side wall is less than that of the closed end, permitting more of the heater energy to be concentrated in the closed end which carries, on the outer surface thereof, the electron emissive material.

4 Claims, 3 Drawing Figures

CATHODE RAY TUBE CATHODE

BACKGROUND OF THE INVENTION

This invention relates to cathodes and more particularly to fast warmup cathodes for cathode ray tubes. Still more particularly, the cathode has application in the multiple gun structure of color cathode ray tubes. Conventional cathode ray tubes of the color variety are provided with multiple electron guns, each of which contains an electron emitting cathode. The cathodes are usually indirectly heated, that is, they comprise a tubular cathode assembly having an insulated filamentary heater contained therewithin to provide the heat necessary to cause an emissive material to emit electrons. The cathodes conventionally employed in color cathode ray tubes normally have a warmup time of 12 to 15 seconds; that is, it requires that long of a time for sufficient electrons to be present from the cathode to be drawn to the anode and establish a raster on the face plate of the picture tube. These warmup times have been considered to be detrimental to the viewing public in that it requires a long wait from turn-on to an acceptable or viewable picture on the tube. In the past, this detrimental condition had been obviated by the provision of an "instant-on" feature provided by some television receiver manufacturers. With this feature a raster on viewable picture is obtained on the picture tube almost instantaneously with the turn-on of the set; however, this feature has not in the past been accomplished by a fast warmup cathode, but rather by a bleeder current which constantly maintains the cathode heater at a near normal operating temperature. Thus in effect, the cathode ray tube is never completely turned off. When the television receiver is either a complete tube version including many receiving tubes or a hybrid version including some receiving tubes and some solid state devices, the bleeder current with the "instant-on" feature is also applied to the heaters of the other receiving tubes within the set. This condition has been alleged to provide a dangerous fire hazard in some receivers. It is also quite wasteful of electrical energy since, as mentioned above, a receiver is never completely turned off and the set is constantly drawing electrical power. It would be a decided advancement in the art if a more economical fast warmup system could be provided. Attempts have been made in the past to provide fast warmup cathodes; however, many of the proposed types have been either extremely difficult to build or have been very expensive or have required considerable design changes in the conventional electron gun structures.

OBJECTS AND SUMMARY OF THE INVENTION

It is, therefore, an object of the invention to obviate the disadvantages of the prior art.

It is another object of the invention to enhance the warmup characteristics of color cathode ray tubes.

It is yet another object of the invention to provide an acceptable and economical fast warmup cathode for color cathode ray tubes.

Yet another object of the invention is the provision of a fast warmup cathode in a configuration such that no other changes are necessary in the gun structure of a conventional color cathode ray tube, other than the inclusion of the new cathode.

Still another object of the invention is the provision of a cathode cap having superior heating characteristics.

These objects are accomplished in one aspect of the invention by the provision of a die-drawn, low mass cathode cap for a multipart cathode assembly. The cathode cap is substantially cup-shaped with a closed end and integral upstanding sidewall. The closed end of the cap has a given thickness and the sidewall has a thickness substantially less than that of the closed end. The cathode cap above described is ideally suited for use in a multipart cathode which is attached to a cathode sleeve or support by a plurality of limited contact area tabs which provide poor heat conduction between cap and the stack. Such cathode stacks are shown for example in U.S. Patent 3,881,124 which is assigned to the assignee of the present invention.

DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
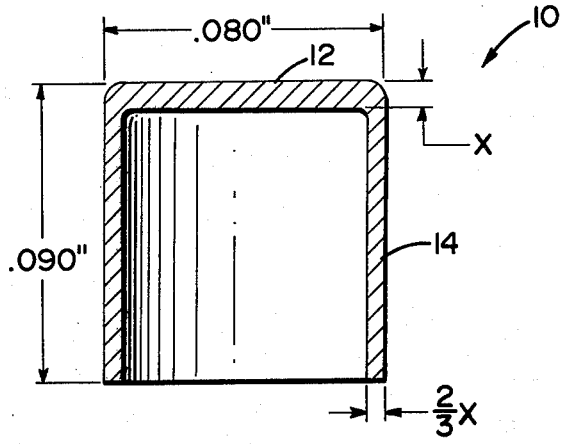
FIG. 1 is a sectional elevational view of one embodiment of the invention.

Referring now to the invention with greater particularity, there is shown in FIG. 1 a cathode cap 10 constructed in accordance with the invention. Cathode cap 10 is a low mass, die-drawn substantially cup-shaped unit having a closed end 12 with an integral upstanding sidewall 14. From the illustration it will be seen that closed end 12 has a given thickness designated in this instance as $x$. However, cap 10 has been fabricated so that sidewall 14 has a thickness that is approximately ⅓ $x$. In a more or less typical embodiment of cap 10; that is, for use in a conventional three-gun color cathode ray tube, the cap will have a diameter of about 0.080 inch (2.032 mm) and a wall length of about 0.090 inch (2.286 mm). While shown greatly exaggerated in the drawing a typical thickness for closed end 12 will be about 0.003 inch (0.0762 mm) and a typical thickness for wall 14 will be 0.002 inch (0.0508 mm).

Figure 2:
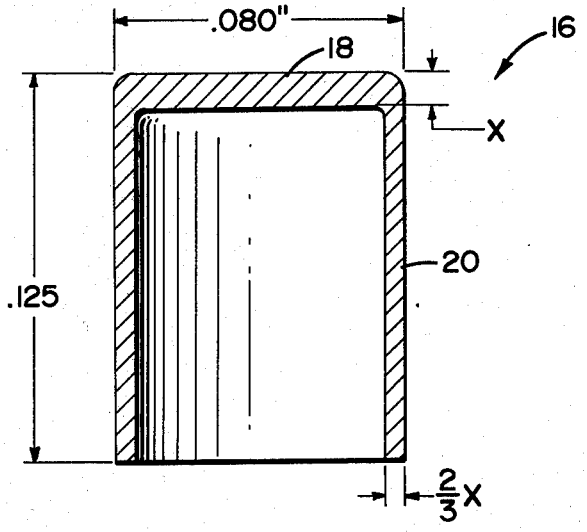
FIG. 2 is a sectional elevational view of a second embodiment of the invention.

An alternate embodiment of the invention is shown in FIG. 2. Herein a cathode cap 16 is shown as having a closed end 18 and upstanding wall 20. The thicknesses of the closed end 18 and wall 20 can be the same as described above in regard to FIG. 1, and the diameter of the cap can also be the same as that described in FIG. 1, namely 0.080 inches (2.032 mm). It will be seen however that the length of a wall in this particular instance is 0.125 inch (3.175 mm).

In various tests that were performed it was found that even the lengthened sidewall with the thinner construction performed favorable when compared to a typical prior art cathode cap having the wall thickness and closed end thickness the same. For example, in one test a cathode cap with a wall length of 0.090 inch (2.286 mm), a closed end thickness of 0.003 inch (0.0762 mm), and a wall thickness of 0.003 inch (0.0762 mm) and having a mass of 11.2 milligrams for a control was compared with a cathode cap of the type shown in FIG. 2 having a wall length of 0.125 inch (3.175 mm), a closed end thickness of 0.003 inch (0.0762 mm), and a wall thickness of 0.002 inch (0.0508 mm) and having a mass of 10.5 milligrams and a cap of the type shown in FIG. 1 having a 0.090 inch (2.286 mm) wall length with a closed end thickness of 0.003 inch (0.0762 mm), and a wall thickness of 0.002 inch (0.0508 mm), and a mass of 7.5 milligrams. The new low mass, thin walled cathode cap achieved a significantly greater measure of warmup in a short period of time than the old cathode cap. A comparison of the results of the test as shown in the following chart.

WARM UP TIME (Seconds) TO $I_s$ LEVEL*

| | | 4μA | 100μA | 150μA |
|---|---|---|---|---|
| | 0.090" Thin Wall | 3.83 | 4.87 | 5.80 |
| | 0.125" Thin Wall | 3.87 | 5.13 | 6.30 |
| (Control) | 0.090" Thick Wall | 5.00 | 7.20 | 10.37 |

*All data gathered with stable $I_s$ set for 300μA for all tubes.

In reducing the mass of the cathode a number of areas demand consideration. First, the thickness of the cap cannot be reduced below that needed for mechanical stability in supporting the electron emissive material.

Second, the length of the cap walls cannot be shortened beyond the point at which the electrical field of the heater will draw an excessive number of electrons from the oxide emission coating. Third, there are also limitations on the minimum size which can be achieved in a heater coil body and still maintain a desirable level of power available at suitable combinations of heater currents and voltages. Fourth, an undesirable amount of radiant energy will be wasted if a substantial portion of the heater coil body extends out of the cap sidewall.

All of the above tests were run with the same design heater, available as CRC–7710, from GTE Sylvania Incorporated, Exeter, N. H. This heater has a coil body length of approximately 0.118 inch (3 mm), a coil diameter of 0.068 inch (1.728 mm), and an overall length including legs of approximately 0.520 inch (13 mm). The 0.003 inch (0.0762 mm) rhenium-tungsten alloy wire is covered with a 0.003 inch (0.0762 mm) layer of sintered aluminum oxide insulation. This heater construction is similar to that shown in the above mentioned U.S. Pat. No. 3,881,124.

Figure 3:
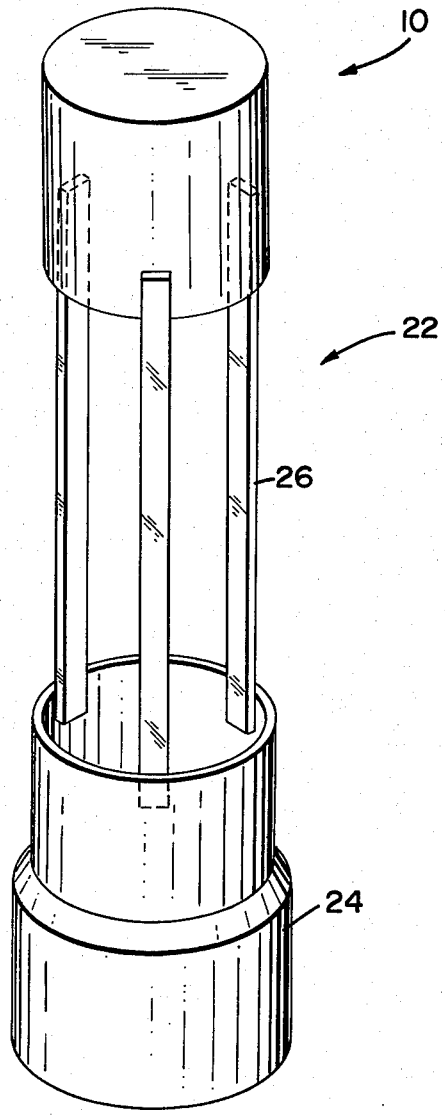
FIG. 3 is a perspective view of a simplified, typical cathode assembly employing the invention.

The cathode cap of this invention has its best utility in a cathode assembly of the type shown in FIG. 3. Herein the cathode assembly 22 is shown as comprising a cathode cap, for example, 10 and a sleeve portion 24. The cathode cap and cathode sleeve portion are connected by means of a plurality of poor heat conducting connectors 26. In this particular instance three are shown. These cathode connectors can be in the form of thin rigid rods or straps welded appropriately to the cathode cap 10 and cathode sleeve 24 or they can be one of the other embodiments shown in the above mentioned U.S. Pat. No. 3,881,124.

It is necessary for all practical purposes that the cathode cap of this invention be utilized with such a supporting structure. For example, to use the low mass, thin wall cathode cap described herein with a conventional support sleeve which comprises merely a hollow tube with a more or less contiguous fit of the cap over the tube would defeat the purpose of the low mass cathode cap.

While there has been shown what are at present considered to be the preferred embodiments of the invention, it will be apparent to those skilled in the art that various changes and modifications can be made herein without departing from the scope of the invention as defined by the appended claims.

What is claimed is:

1. A die-drawn, low mass cathode cap for a multipart cathode assembly; said cathode cap being substantially cup-shaped with a closed end and an integral upstanding side wall; said closed end having a given thickness and the entire length of said side wall having a thickness substantially less than that of said closed end.

2. The cathode cap of claim 1 wherein said cap is circular in cross-section and has a given diameter and the length of said side wall is approximately the same as said diameter.

3. The cathode of claim 1 wherein said cap is formed from a material selected from the group of nickel and cathode nickel alloys.

4. The cathode cap of claim 1 wherein said side wall is about 66% of the thickness of said closed end.

* * * * *

UNITED STATES PATENT AND TRADEMARK OFFICE

CERTIFICATE OF CORRECTION

PATENT NO. : 3,974,414

DATED : August 10, 1976

INVENTOR(S) : William E. Buescher and Donald R. Kerstetter

It is certified that error appears in the above-identified patent and that said Letters Patent are hereby corrected as shown below:

Column 2, line 42 -- Please delete "1/3 x" and insert -- 2/3 x --.

Signed and Sealed this

Second Day of November 1976

[SEAL]

*Attest:*

RUTH C. MASON
*Attesting Officer*

C. MARSHALL DANN
*Commissioner of Patents and Trademarks*